US005848733A

United States Patent [19]

Foster et al.

[11] Patent Number: 5,848,733

[45] Date of Patent: Dec. 15, 1998

[54] MANUALLY OPERATED PUMP DISPENSER HAVING CHILD-RESISTANT NOZZLE

[75] Inventors: Donald D. Foster, St. Charles, Mo.; Bert D. Heinzelman, Tenafly, N.J.; Donald R. Lamond, Lynbrook, N.Y.; William Fiebel, Passaic, N.J.

[73] Assignee: Continental Sprayers International, Inc., St. Peters, Mo.

[21] Appl. No.: 745,439

[22] Filed: Nov. 12, 1996

[51] Int. Cl.[6] ..... B67D 5/32

[52] U.S. Cl. ..... 222/153.13; 222/321.8; 222/383.1; 239/333

[58] Field of Search ..... 222/153.13, 153.14, 222/383.1, 321.8; 239/333

[56] References Cited

U.S. PATENT DOCUMENTS

| | | | |
|---|---|---|---|
| 4,204,614 | 5/1980 | Reeve | 222/153 |
| 4,257,561 | 3/1981 | McKinney | 239/581 |
| 4,346,821 | 8/1982 | Wesner et al. | 222/153 |
| 4,516,695 | 5/1985 | Garneau | 222/153 |
| 4,971,227 | 11/1990 | Knickerbocker et al. | 222/153 |
| 5,040,701 | 8/1991 | Knickerbocker et al. | 222/153 |
| 5,040,702 | 8/1991 | Knickerbocker et al. | 222/153 |
| 5,050,779 | 9/1991 | Knickerbocker | 222/153.14 |
| 5,161,716 | 11/1992 | Knickerbocker | 222/153 |
| 5,169,032 | 12/1992 | Steijns et al. | 222/153 |
| 5,228,600 | 7/1993 | Steijns et al. | 222/153.14 |
| 5,238,152 | 8/1993 | Maas et al. | 222/153 |
| 5,297,701 | 3/1994 | Steijns et al. | 222/153.14 |
| 5,477,989 | 12/1995 | Maas et al. | 222/153.14 |
| 5,482,186 | 1/1996 | Rodden, Jr. | 222/153.07 |
| 5,687,880 | 11/1997 | Maas et al. | 222/153.14 |

*Primary Examiner*—Joseph Kaufman
*Attorney, Agent, or Firm*—Howell & Haferkamp, L.C.

[57] ABSTRACT

A child-resistant liquid dispenser such as a trigger sprayer. The dispenser comprises a dispenser body, a nozzle, and a locking mechanism. The dispenser body has a nozzle receiving end and a discharge passage configured for discharging liquid through the nozzle receiving end. The-nozzle has a nozzle opening therein and is connected to the nozzle receiving end of the dispenser body. The nozzle is rotatable relative to the dispenser body about a nozzle axis X between open and closed positions. The nozzle and dispenser body are configured such that the nozzle opening is in fluid communication with the discharge passage of the dispenser body when the nozzle is in its open position to permit fluid to flow from the discharge passage and through the nozzle opening. They are further configured such that fluid communication between the nozzle opening and discharge passage is blocked when the nozzle is in its closed position to prevent fluid flow from the discharge passage and through the nozzle opening. The locking mechanism comprises a locking member adjacent the nozzle and dispenser body. The locking member is moveable along the nozzle axis X between locking and unlocking positions. The locking mechanism, dispenser body, and nozzle are configured to prevent rotational movement of the nozzle from its closed position to its open position when the locking member is in its locking position and to allow rotational movement of the nozzle between its closed and open positions when the locking member is in its unlocking position.

21 Claims, 3 Drawing Sheets

MANUALLY OPERATED PUMP DISPENSER HAVING CHILD-RESISTANT NOZZLE

BACKGROUND OF THE INVENTION

This invention relates generally to manually-operated pump dispensers such as trigger sprayers, and more particularly to such pump dispensers having child resistant features.

Child-resistant nozzle assemblies for trigger sprayers are known. One conventional child-resistant nozzle assembly includes a nozzle cap rotatably connected to a dispenser body. A resilient protrusion extends forward from the dispenser body. The protrusion is resiliently moveable between an unflexed position and a flexed position. In the unflexed position, the protrusion engages a slot formed in a top surface of the nozzle cap to prevent the cap from turning. In the flexed position, the protrusion is flexed upward and away from the nozzle cap so that it does not interfere with turning of the cap. Another conventional child-resistant nozzle assembly includes a lug which is configured to be pressed radially inwardly for unlocking the cap to permit cap rotation to allow fluid discharge. These prior art child-resistant nozzle assemblies generally require significant dexterity or strength to operate, making them difficult to operate even by an adult.

SUMMARY OF THE INVENTION

Among the several objects of the present invention may be noted the provision of an improved child-resistant dispenser; the provision of such a dispenser having a child-resistant nozzle which is easily operated by an adult, but which is not easily operated by a child; the provision of such a dispenser which has a minimum number of parts; the provision of such a dispenser which is relatively low in cost; and the provision of such a fluid pump which is of relatively simple construction.

Generally, a child-resistant liquid dispenser of the present invention comprises a dispenser body, a nozzle, and a locking mechanism. The dispenser body has a nozzle receiving end and a discharge passage configured for discharging liquid through the nozzle receiving end. The nozzle has a nozzle opening therein and is connected to the nozzle receiving end of the dispenser body. The nozzle is rotatable relative to the dispenser body about a nozzle axis X between open and closed positions. The nozzle and dispenser body are configured such that the nozzle opening is in fluid communication with the discharge passage of the dispenser body when the nozzle is in its open position to permit fluid to flow from the discharge passage and through the nozzle opening. The nozzle and dispenser body are further configured such that fluid communication between the nozzle opening and discharge passage is blocked when the nozzle is in its closed position to prevent fluid to flow from the discharge passage and through the nozzle opening. The locking mechanism comprises a locking member adjacent the nozzle and dispenser body. The locking member is moveable along the nozzle axis X between locking and unlocking positions. The locking mechanism, dispenser body, and nozzle are configured to prevent rotational movement of the nozzle from its closed position to its open position when the locking member is in its locking position and to allow rotational movement of the nozzle between its closed and open positions when the locking member is in its unlocking position.

Other objects and features will be in part apparent and in part pointed out hereinafter.

BRIEF DESCRIPTION OF THE DRAWINGS

Corresponding reference characters indicate corresponding parts throughout the several views of the drawings.

DESCRIPTION OF THE PREFERRED EMBODIMENT

Figure 1:
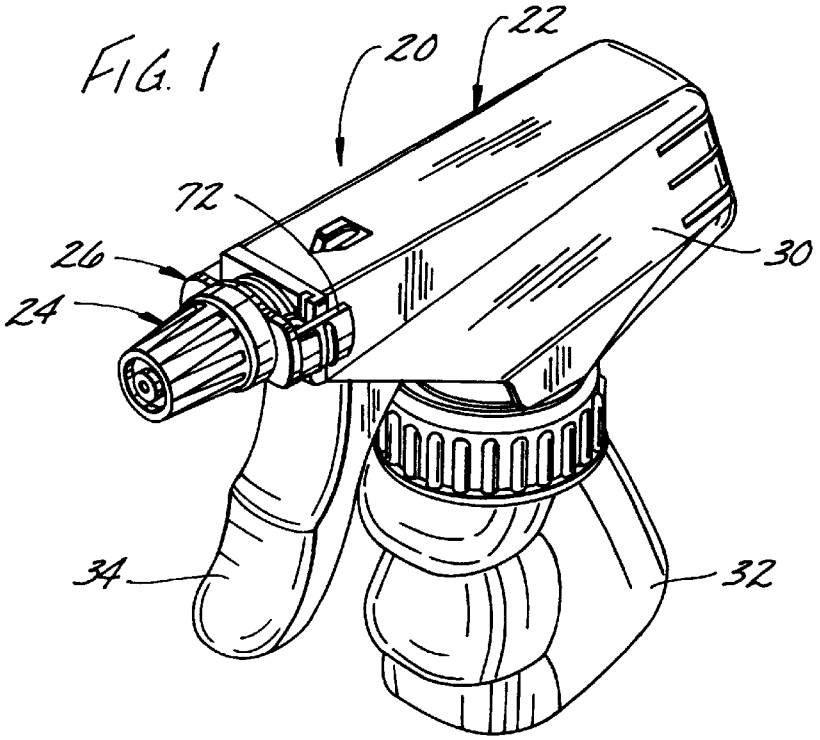
FIG. 1 is a fragmented perspective view of a child-resistant liquid dispenser of the present invention.
Figure 2:
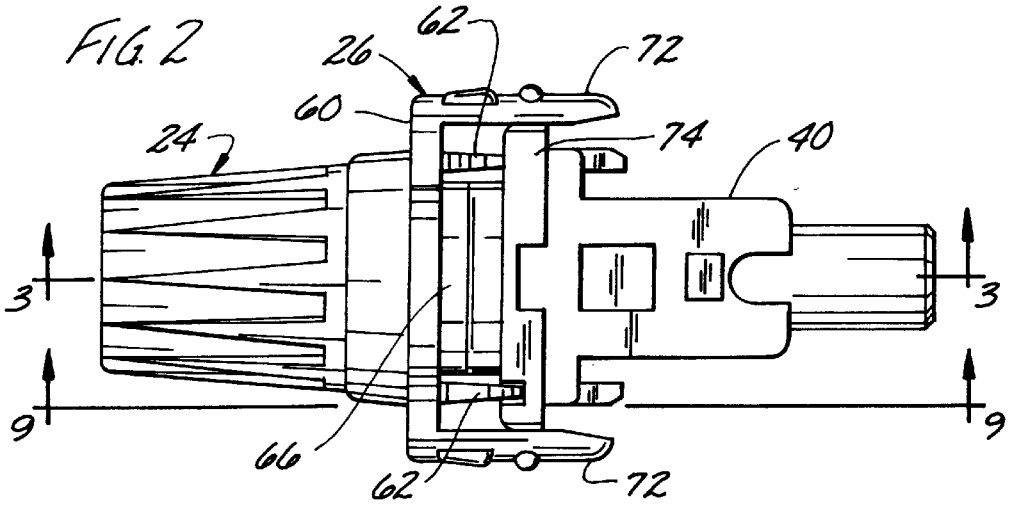
FIG. 2 is an enlarged top plan view of a nozzle cap, locking mechanism, and part of a dispenser body of the liquid dispenser of FIG. 1.
Figure 3:
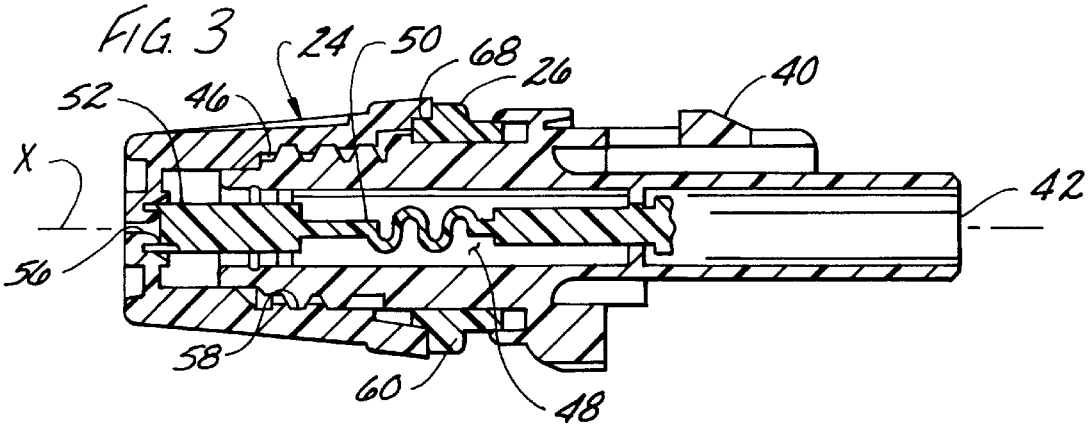
FIG. 3 is a cross-sectional view taken along the plane of line 3—3 of FIG. 2, showing the nozzle cap rotated to a rearward-most closed position in which the nozzle cap engages a forward end of a spinner mechanism of the dispenser body in a manner to prevent fluid flow through the nozzle cap.

Referring now to the drawings, and first more particularly to FIG. 1, a child-resistant liquid dispenser of the present invention is indicated in its entirety by the reference numeral 20. Preferably, the liquid dispenser 20 comprises a manually operated trigger sprayer. However, it is to be understood that other types of dispensers could be used without departing from the scope of this invention.

The liquid dispenser 20 includes a dispenser body, generally indicated at 22, a nozzle or nozzle cap 24, and a locking mechanism, generally indicated at 26. The dispenser body 22 includes a dispenser housing 30, a manually operated pump mechanism (not shown) within the dispenser housing for drawing liquid from a container 32 and dispensing it through a discharge conduit (not shown) formed in the dispenser housing. A dip tube extends from the bottom of the container interior to the dispenser housing 30 so liquid may be drawn from the container. The pump mechanism has an expandable chamber which draws liquid from the container 32 as it is expanded and expels the liquid through the discharge conduit as it is contracted. Preferably, the pump mechanism is expanded and contracted by forward and rearward movement of a trigger 34.

Referring now to FIGS. 1–4, the dispenser body 22 further includes a cap receiving member 40 having an upstream end 42 sized and shaped for a snug compression fit in the downstream end of the discharge conduit, and a threaded downstream end 46 sized for receiving the nozzle cap 24. The cap receiving member 40 further includes a discharge passage 48 extending therethrough in fluid communication with the discharge conduit. The dispenser body 22 further includes a spinner assembly 50 within the discharge conduit and having a central stem 52. The spinner assembly 50 preferably operates in the same way and is similar to the spinner assembly described in U.S. Pat. No. 5,234,166, incorporated herein by reference.

Figure 4:
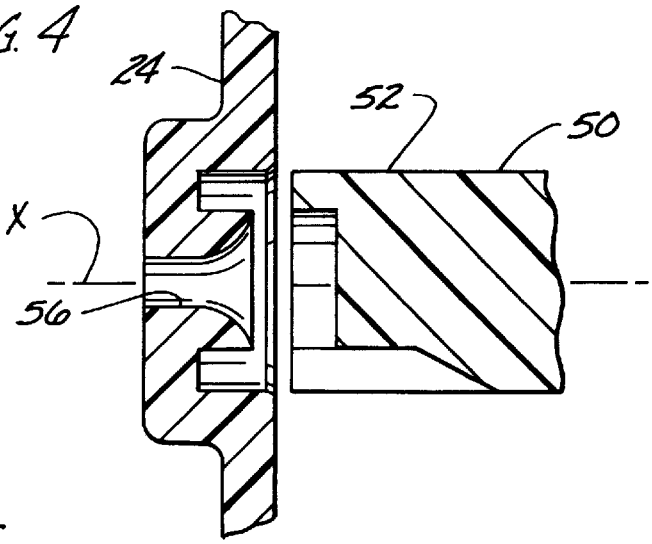
FIG. 4 is a fragmented view showing the nozzle cap rotated to a forward open position in which the nozzle cap is spaced from the spinner mechanism to permit fluid flow through the nozzle cap.
Figure 5:
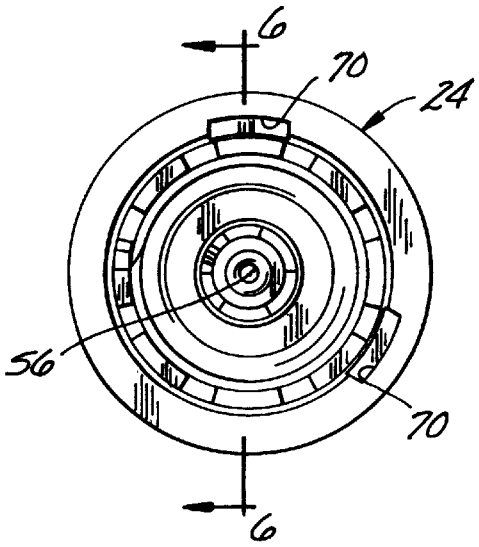
FIG. 5 is a rear end elevational view of the nozzle cap of FIG. 2.
Figure 6:
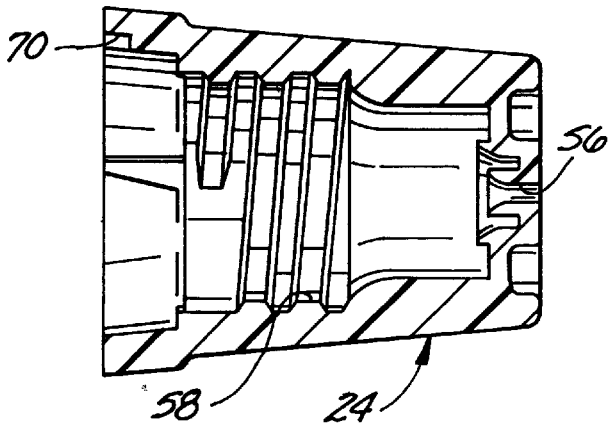
FIG. 6 is a cross-sectional view taken along the plane of line 6—6 of FIG. 5.
Figure 7:
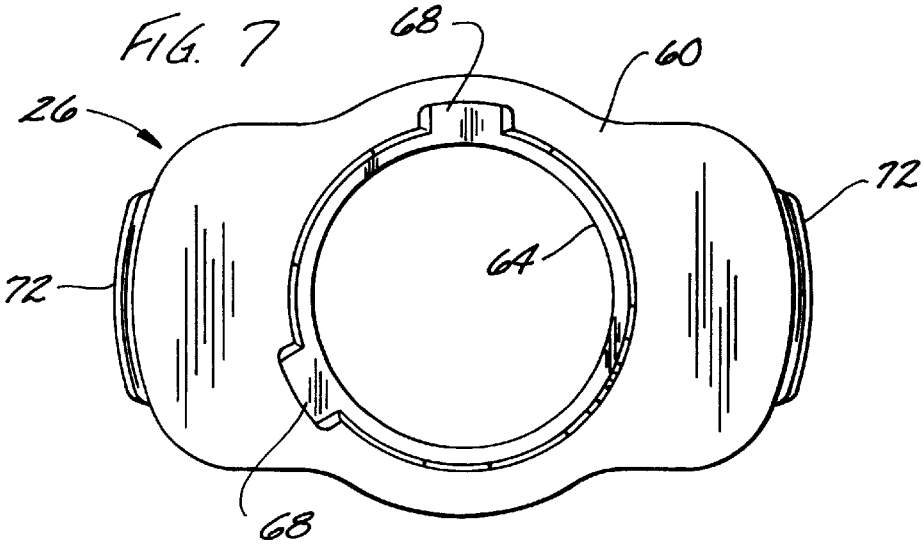
FIG. 7 is a front end elevational view of the locking mechanism of FIG. 2.
Figure 8:
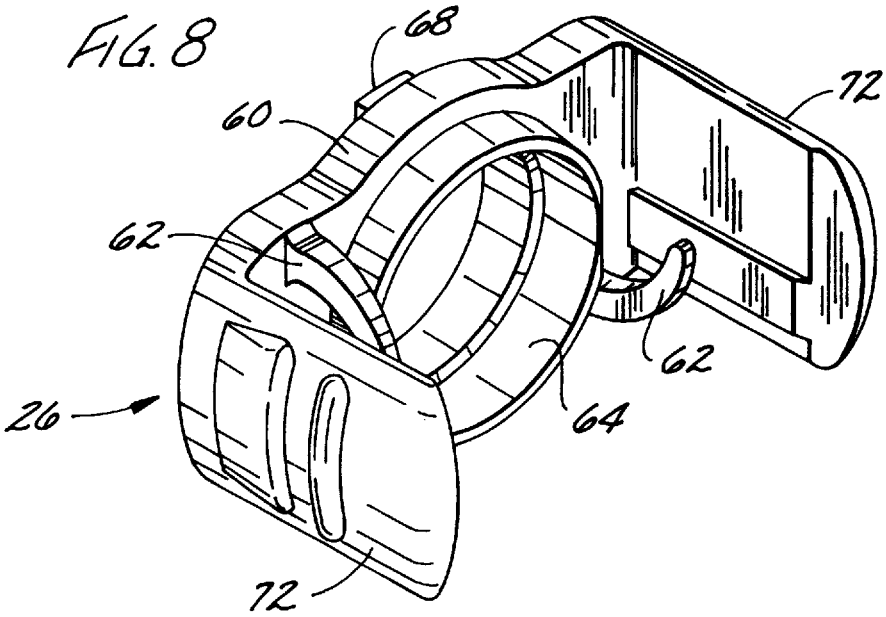
FIG. 8 is a perspective view of the locking mechanism of FIG. 7.

The nozzle cap 24 (FIGS. 5 and 6) has a nozzle opening 56 therethrough and an internal thread 58 sized for engaging the threaded downstream end 46 of the cap receiving member 40 to allow the nozzle cap to be turned (or rotated) on the cap receiving member about an axis X between a rearward closed position (FIG. 3) and a forward open position (FIG. 4). When the nozzle cap 24 is in its rearward closed position, the central stem 52 seats against an inner surface of the nozzle cap all around the nozzle opening 56 to prevent fluid flow through the nozzle opening. When the nozzle cap 24 is in its forward open position, the inner surface of the nozzle cap is spaced forward of the central stem 52 and fluid is permitted to flow around the stem and through the nozzle opening.

Figure 9:
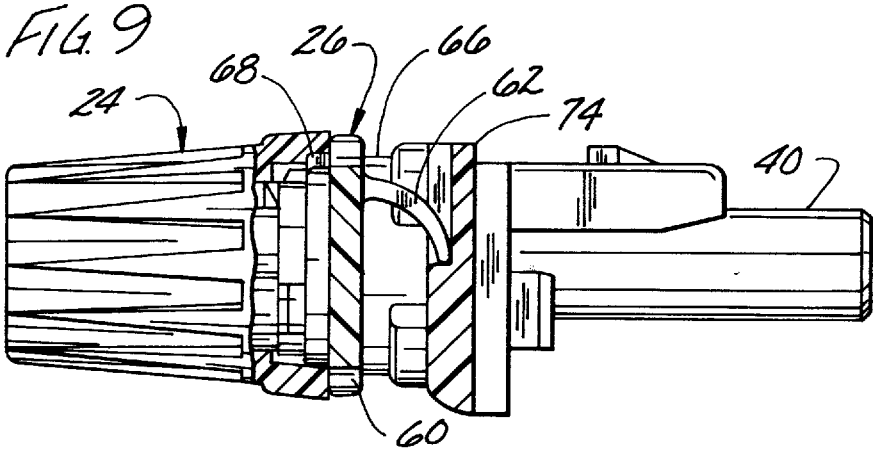
FIG. 9 is a cross-sectional view taken along the plane of line 9—9 of FIG. 2, with a portion of the closure cap broken away to show detail, the view showing the locking mechanism in a locking position to prevent rotation of the nozzle cap relative to the dispenser body.
Figure 10:
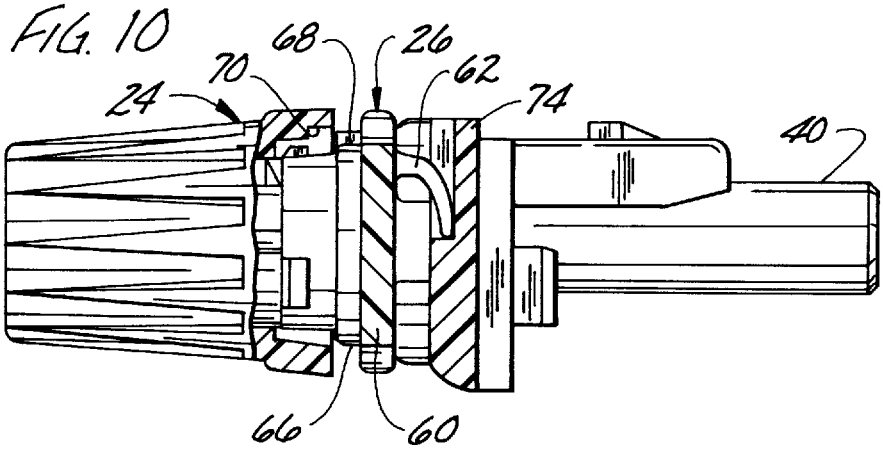
FIG. 10 is a cross-sectional view similar to that of FIG. 9 but with the locking mechanism in an unlocking position to permit rotation of the nozzle cap relative to the dispenser body.

The locking mechanism 26 is preferably a single unitary piece and includes a locking member (or locking collar) 60 and two spring portions (or members) 62. The locking collar 60 includes a central bore 64 therethrough sized for a sliding fit over a cylindrical outer surface 66 of the cap receiving member 40. The locking collar 60 includes at least one and preferably at least two forwardly-extending protrusions 68. The protrusions 68 are sized and shaped for extending into a like number of slots 70 in the rearward end of the nozzle cap 24. Preferably, the protrusions 68 and slots 70 are shaped and arranged so that the protrusions align with and can extend into the slots only when the nozzle cap 24 is rotated to its closed position. The locking collar 60 is slidable on the cylindrical surface 66 along the axis X between a forward locking position (FIG. 9) and a rearward unlocking position (FIG. 10). The locking collar 60 further includes two rearwardly extending fingers 72 and the cap receiving member 40 includes a generally rectangular flange 74. The fingers 72 are closely adjacent opposite edges of the flange 74 and slide along these edges as the locking collar 60 is moved between its forward and rearward positions. Engagement of the fingers 72 with the flange 74 prevents the locking collar 60 from rotating relative to the cap receiving member. The fingers 72 serve the additional purpose of acting as a portion to be grasped by the user to enable the user to move the locking collar 60 between its forward and rearward positions. When the nozzle cap 24 is in its closed position and when the locking collar 60 is in its forward locking position, the protrusions 68 of the locking collar extend into the slots 70 of the nozzle cap 24 to prevent rotation of the nozzle cap relative to the locking collar and to the cap receiving member 40. When the locking collar 60 is in its rearward unlocking position, the protrusions 68 of the locking collar are spaced rearwardly from the nozzle cap 24 and therefore do not interfere with rotation of the nozzle cap.

The spring members 62 of the locking mechanism 26 extend from the locking collar 60 and have rear ends which press against the flange 74 of the cap receiving member 40. The spring members 62 bias the locking collar 60 in its forward position and urge the locking collar forward whenever the locking collar is between its forward and rearward positions. Thus, when the nozzle cap 24 is in its closed position, the spring members 62 urge the locking collar 60 forward to its locking position where the protrusions 68 engage the slots 70 to prevent rotation of nozzle cap 24 out of its closed position. Because of the spring members 62, a user must manually move the locking collar 60 rearward to its unlocking position and hold it in this position before the nozzle cap 24 can be rotated to its open position.

In operation, the nozzle cap 24 of the liquid dispenser 20 is initially in its closed position and the locking collar 60 of the locking mechanism 26 is in its forward position so that the protrusions 68 lock the nozzle cap in its closed position. With the nozzle cap 24 in its closed position, liquid cannot be dispensed through the dispenser 20. To dispense liquid from the dispenser 20, the nozzle cap 24 must be rotated to its open position. A user accomplishes this by gripping the fingers 72 of the locking collar 60 and pulling the locking collar rearwardly relative to the cap receiving member 40 and against the bias of the spring members 62. The user then holds the locking collar 60 in its unlocking position and simultaneously turns the nozzle cap 24 about the axis X to its open position. The user may then release the locking collar 60 and begin squeezing the trigger 34 to dispense fluid forward through the discharge conduit, through the discharge passage of the cap receiving member 40 and out the nozzle opening 56. When the locking collar 60 is released, the spring members 62 push it forward against the rear end of the nozzle cap 24. However, because the slots 70 of the nozzle cap 24 do not align with the protrusions 68 of the locking collar 60 when the nozzle cap is in its open position, the locking collar is not moved to its locking position and does not prevent cap rotation. Because the locking, collar 60 cannot be in its locking position unless the nozzle cap 24 is in its closed position, a user can easily observe whether the nozzle-cap is open or closed. Thus, the locking collar 60 constitutes, among other things, a visual indicator of whether the nozzle cap 24 is in its closed position. When the user turns the nozzle cap 24 to its closed position, then the slots 70 align with the protrusions 68 and the biasing force of the spring members 62 pushes the locking collar 60 forward to its locking position. Although the user must pull the locking collar 60 rearwardly in order to move the nozzle cap 24 from its closed position to its open position, he/she need not pull the collar rearwardly in order to move the nozzle cap from its open position to its closed position. Thus, the nozzle cap 24 may be readily closed. Because a user must simultaneously hold the locking collar 60 in its unlocking position and turn the nozzle cap 24 from its closed position to its open position in order to dispense liquid from the dispenser 20, it is difficult for a young child to operate the dispenser. Although the configuration of the dispenser parts makes it difficult for a young child to operate the dispenser, it does not take much strength or dexterity to open the nozzle. Thus, the dispenser is easily operated by an adult.

Although the spring members 62 and locking collar 60 are preferably of a one piece construction, it is to be understood that the spring members could be separate from the locking collar without departing from the scope of this invention. Alternatively, the spring members could be integrally formed with the cap receiving member. Further, the locking collar could be shaped and configured to rotate with the nozzle cap and have rearwardly extending protrusions which releasably engage slots formed in the cap receiving member. With such an arrangement, it is contemplated that spring members would bias the locking collar rearwardly in a locking position in which the locking collar is locked against rotation relative to the cap receiving member.

In view of the above, it will be seen that the several objects of the invention are achieved and other advantageous results attained.

As various changes could be made in the above constructions without departing from the scope of the invention, it is intended that all matter contained in the above description or shown in the accompanying drawings shall be interpreted as illustrative and not in a limiting sense.

What is claimed is:

1. A child-resistant liquid dispenser comprising:

a dispenser body having a nozzle receiving end and a discharge passage configured for discharging liquid through the nozzle receiving end;

a nozzle having a nozzle opening therein and being connected to the nozzle receiving end of the dispenser body, the nozzle being rotatable relative to the dispenser body about a nozzle axis X between open and closed positions, the nozzle and dispenser body being configured such that the nozzle opening is in fluid communication with the discharge passage of the dispenser body when the nozzle is in its open position to permit fluid to flow from the discharge passage and through the nozzle opening, the nozzle and dispenser body further being configured such that fluid communication between the nozzle opening and discharge passage is blocked when the nozzle is in its closed position to prevent fluid flow from the discharge passage and through the nozzle opening; and a locking mechanism comprising a locking member adjacent the nozzle and dispenser body, said locking member being moveable along the nozzle axis X between locking and unlocking positions;

said locking mechanism, dispenser body, and nozzle being configured to prevent rotational movement of the nozzle from its closed position to its open position when the locking member is in its locking position and to allow rotational movement of the nozzle between its closed and open positions when the locking member is in its unlocking position.

2. A liquid dispenser as set forth in claim 1 wherein said locking mechanism further includes a spring portion configured for biasing the locking member in its locking position.

3. A liquid dispenser as set forth in claim 2 wherein the locking mechanism is configured such that movement of the locking member from its locking position to its unlocking position flexes the spring portion to thereby cause the spring portion to urge the locking member to its locking position.

4. A liquid dispenser as set forth in claim 3 wherein the spring member and one of the locking member, dispenser body, and nozzle constitute a single unitary piece.

5. A liquid dispenser as set forth in claim 4 wherein the spring member and the locking member constitute a single unitary piece.

6. A liquid dispenser as set forth in claim 4 wherein the locking member and nozzle are shaped and configured such that the locking member engages the nozzle in a manner to prevent rotation of the nozzle when the locking member is in its locking position, and shaped and configured such that the locking member is spaced from the nozzle sufficiently to avoid interfering with rotation of the nozzle when the locking member is in its unlocking position.

7. A liquid dispenser as set forth in claim 6 wherein the nozzle receiving end of the dispenser body is a forward end of the dispenser body, the locking member being configured to be spaced rearwardly of the nozzle when the locking member is in its unlocking position.

8. A liquid dispenser as set forth in claim 2 wherein the nozzle is rotatable relative to the locking member when the locking member is in its unlocking position.

9. A liquid dispenser as set forth in claim 8 wherein the locking member is mounted on the dispenser body and is in engagement with the dispenser body when the locking member is in its locking position and when the locking member is in its unlocking position.

10. A liquid dispenser as set forth in claim 1 wherein the locking mechanism and nozzle are configured such that the locking mechanism moves axially relative to the nozzle as it is moved between its locking and unlocking positions.

11. A liquid dispenser as set forth in claim 1 wherein the locking member is slidingly connected to the dispenser by and slidingly moveable thereon between its locking and unlocking positions.

12. A liquid dispenser as set forth in claim 1 wherein the locking mechanism and nozzle are configured so that the locking mechanism moves linearly relative to the nozzle as it is moved between its locking and unlocking position.

13. A child-resistant liquid dispenser comprising:

a dispenser body having a nozzle receiving end and a discharge passage configured for discharging liquid forward through the nozzle receiving end;

a nozzle having a nozzle opening therein and being connected to the nozzle receiving end of the dispenser body, the nozzle being rotatable relative to the dispenser body about a nozzle axis X between open and closed positions, the nozzle and dispenser body being configured such that the nozzle opening is in fluid communication with the discharge passage of the dispenser body when the nozzle is in its open position to permit fluid to flow forward from the discharge passage and through the nozzle opening, the nozzle and dispenser body further being configured such that fluid communication between the nozzle opening and discharge passage is blocked when the nozzle is in its closed position to prevent fluid to flow from the discharge passage and through the nozzle opening; and a locking mechanism comprising a locking member adjacent the nozzle and dispenser body, said locking member being moveable on the dispenser body and along the nozzle axis X between a forward locking position and a rearward unlocking position;

said locking mechanism, dispenser body, and nozzle being configured to prevent rotational movement of the nozzle from its closed position to its open position when the locking member is in its locking position and to allow rotational movement of the nozzle between its closed and open positions when the locking member is in its unlocking position.

14. A liquid dispenser as set forth in claim 13 wherein said locking mechanism further includes a spring portion configured for biasing the locking member in its forward locking position.

15. A liquid dispenser as set forth in claim 14 wherein the locking mechanism is configured such that the spring portion urges the locking member forward toward its locking position when the locking member is between its locking and unlocking positions.

16. A liquid dispenser as set forth in claim 15 wherein the spring member and one of the locking member and dispenser body constitute a single unitary piece.

17. A liquid dispenser as set forth in claim 16 wherein the locking member and nozzle are shaped and configured such that the locking member engages the nozzle in a manner to prevent rotation of the nozzle when the locking member is in its locking position, and shaped and configured such that the locking member is spaced rearwardly from the nozzle sufficiently to avoid interfering with rotation of the nozzle when the locking member is in its unlocking position.

18. A liquid dispenser as set forth in claim 15 wherein the spring member and the locking member constitute a single unitary piece.

19. A liquid dispenser as set forth in claim 13 wherein the nozzle is rotatable relative to the locking member when the locking member is in its unlocking position.

20. A liquid dispenser as set forth in claim 13 wherein the locking mechanism and nozzle are configured such that the locking mechanism moves axially relative to the nozzle as it is moved between its locking and unlocking positions.

21. A liquid dispenser as set forth in claim 13 wherein the dispenser is a manually operable trigger sprayer.

* * * * *